US009109606B2

(12) United States Patent
Boufflert et al.

(10) Patent No.: US 9,109,606 B2
(45) Date of Patent: Aug. 18, 2015

(54) PUMP HAVING AN AXIAL BALANCING DEVICE

(75) Inventors: Sébastien Boufflert, Louviers (FR); Nicolas Juhel, Grenoble (FR); Patrice Fayolle, Saint Marcel (FR); Stéphane Laffite, Vernon (FR)

(73) Assignee: SNECMA, Paris (FR)

( * ) Notice: Subject to any disclaimer, the term of this patent is extended or adjusted under 35 U.S.C. 154(b) by 1072 days.

(21) Appl. No.: 13/143,616

(22) PCT Filed: Jan. 8, 2010

(86) PCT No.: PCT/FR2010/050027

§ 371 (c)(1),
(2), (4) Date: Oct. 28, 2011

(87) PCT Pub. No.: WO2010/079309

PCT Pub. Date: Jul. 15, 2010

(65) Prior Publication Data

US 2012/0148384 A1 Jun. 14, 2012

(30) Foreign Application Priority Data

Jan. 9, 2009 (FR) ..... 09 50107

(51) Int. Cl.
*F04D 29/042* (2006.01)
*F04D 29/22* (2006.01)

(52) U.S. Cl.
CPC ..... *F04D 29/042* (2013.01); *F04D 29/2266* (2013.01)

(58) Field of Classification Search
CPC ..... F04D 29/042; F04D 29/2266
USPC ..... 415/104, 106, 110, 113, 174.5
See application file for complete search history.

(56) References Cited

U.S. PATENT DOCUMENTS

| | | | | |
|---|---|---|---|---|
| 1,020,699 | A * | 3/1912 | Kieser | 415/106 |
| 1,488,931 | A * | 4/1924 | Marechal | 415/106 |
| 4,867,633 | A * | 9/1989 | Gravelle | 415/106 |
| 5,385,442 | A * | 1/1995 | Lehe et al. | 415/104 |
| 7,445,213 | B1 * | 11/2008 | Pelfrey | 277/418 |
| 7,641,451 | B2 | 1/2010 | Lee | |

FOREIGN PATENT DOCUMENTS

| | | |
|---|---|---|
| CH | 330272 | 5/1958 |
| DE | 922 807 | 1/1955 |
| DE | 15 28 717 | 10/1969 |

(Continued)

*Primary Examiner* — Nathaniel Wiehe
*Assistant Examiner* — Woody A Lee, Jr.
(74) *Attorney, Agent, or Firm* — Preti Flaherty Beliveau & Pachios LLP

(57) ABSTRACT

The pump includes a stator and a rotor having an impeller in which a fluid duct passes. An axial balancing device arranged on this wheel includes a rear balancing chamber and a passage arranged between the wheel and the stator, enabling evacuation of fluid from the fluid duct to the balancing chamber. The pressure of fluid in the balancing chamber compensates the pressures exerted by the fluid on the rest of the rotor allowing axial balancing of the rotor. The passage includes an upstream nozzle and a downstream nozzle, as well as an intermediate annular chamber, arranged between walls of the wheel and of the stator, the intermediate chamber being arranged downstream of the upstream nozzle and upstream of the downstream nozzle.

20 Claims, 4 Drawing Sheets

(56) References Cited

FOREIGN PATENT DOCUMENTS

| | | |
|---|---|---|
| DE | 196 31 824 | 2/1998 |
| FR | 405 266 | 12/1909 |
| JP | 56-109689 | 1/1955 |
| JP | 9-14181 | 1/1997 |
| RU | 2095607 | 11/1997 |

* cited by examiner

PUMP HAVING AN AXIAL BALANCING DEVICE

TECHNICAL FIELD

The present invention relates to the axial balancing of a pump, in particular of a turbopump, especially a spatial motor.

BACKGROUND

It is known that the rotors of these machines often support considerable axial thrusts due to differences in pressure which arise on either side of the wheels, to variations in quantity of movement of fluids conveyed and, in some cases, to the weight or a fraction of the weight of the rotor itself.

Because of this, pumps usually contain devices enabling compensation of the axial thrust exerted by the fluid on the rotor.

These devices are likely to use all the surfaces on the front face (to the side of the vanes) and inversely on the rear face or back of the centrifuge wheels as surfaces on which fluid is to circulate to compensate the axial impingement of forces exerted on the rotating parts. As is known, the back of the last centrifuge wheel, for this reason known as the "balancing piston" is used more particularly for achieving this balancing.

FIGS. 1 and 2 illustrate such a known thrust balancing device arranged between a wheel 11 and a stator 12.

The turbopump of FIG. 1 essentially comprises a rotating assembly placed around a central shaft 26, of reduced length, and comprising a single impeller 11 of a single-stage centrifuging pump mounted on the shaft 26, in the median part of the latter, as well as two turbine wheels 22, mounted on the shaft 26 in the rear part of the latter.

The turbine wheels 22, mounted overhanging the rear of the shaft 26, drive the latter in rotation under the action of a hot gas flow applied to the periphery of the turbine wheels 22, from a gas inlet core 24.

FIG. 1 illustrates for the single-stage pump an impeller 11 of open type, with vanes 6 receiving the working fluid via a suction channel 2 and repelling the pressurised working fluid via a pressure passage 3.

The working fluid is introduced axially via the inlet section 28 and passes directly into the suction channel 2 of the pump.

The different components of the pump are known and their description will not be detailed further, with the exception of the axial balancing system of the pump part of which is visible in FIG. 2.

This axial balancing device or axial thrust balancing device of the rotating assembly is integrated with the impeller 11 and comprises a single rear balancing chamber 18 interposed between the rear part of the wheel 11 and a part of the stator 12, and a passage 20 connecting the rear balancing chamber to the fluid duct.

A balancing chamber is a chamber in which fluid pressure prevails, the action of this pressure on a mobile element (here, the rotor) acting to regulate and slave the position of said element mobile.

Via the passage 20, part of the fluid passing into the fluid duct is drawn off to feed the rear balancing chamber 18 situated on the rear face 16 of the wheel 11.

The front face of this wheel 11 receives the pressure of the fluid duct 14 which tends to move the rotor 10 to the rear. On the other hand, the fluid pressure in the rear balancing chamber 18 tends to move the rotor 10 to the front. Equilibrium is attained when these forces are compensated axially, the effort exerted by the fluid on the rotor 10 at the level of the rear chamber 18 compensating the axial impingement of forces exerted by the fluid on the other parts of the rotor during the various operating phases of the pump.

To reach and maintain this equilibrium, the axial balancing device modulates the feed pressure of the rear chamber 18 via the axial shift of the rotor, as follows:

The fluid-transfer passage 20 has a radial nozzle 40 extending between the rotating wall linked to the rotor 10, that is, to the centrifuge wheel 11, and a wall opposite the stator 12, that is, a fixed wall of the pump. The section for the fluid passage of this radial nozzle depends on the relative axial position of the rotor and of the stator: it increases when the rotor moves to the rear (increase in thickness A of fluid film passing through the passage 20, in FIG. 2, when the wheel 11 moves to the right), which causes an increase in the throughput entering the rear chamber, a rise in pressure in the rear chamber, and accordingly an increase in recoil force exerted by the fluid on the rotor tending to thrust it forwards. Inversely, if the rotor 10 tends to shift to the front (to the detriment of the thickness A of fluid film), the recoil force diminishes via an inverse mechanism, compelling the rotor to retreat more to the rear.

It is understood that the shift of the rotor modulates the pressure in the rear balancing chamber 18, and accordingly keeps the rotor in a substantially constant axial position, and advantageously with minimum friction. The system is auto-regulated, and tends to keep the rotor in its balanced position.

However, in such a thrust-balancing system, since the flow area of the fluid is intrinsically variable, the sole degree of liberty the designer has to vary the effect of the device, and therefore the pressure loss between the upstream and the downstream of this passage, is the radial distance B via which fluid flows into the nozzle of the passage, in this case corresponding to the spread between the internal and external radii of the crown formed by this nozzle.

Now, it is not necessarily to be desired to overly increase this distance B, and with it the dimension of the corresponding walls of the rotor and/or of the stator, as the pump is more sensitive to deformations of these pieces, because of the risk of harmful contact between the rotor and the stator.

Also, the increase in this distance B may not be enough to create the pressure loss necessary to equalise axial thrust, in particular in the case of a single-stage pump with open centrifuge wheel: In this particular case, the only surface on which fluid can be circulated is the balancing piston situated at the back of the wheel. In multi-stage pumps, each wheel can contribute to axial balancing of the pump.

By way of a known alternative solution, if the increase in width of the radial nozzle is insufficient to compensate axial forces, use can be made of an offset axial balancing plate. This brings with it an increase in the complexity of the pump and its execution, and a loss in yield for the pump. Also, especially because of the resulting elongation of the shaft, the axial and/or radial bulk of the pump is increased.

BRIEF SUMMARY

The aim of the invention is to rectify the above disadvantages by defining a pump comprising a stator, a rotor comprising at least one impeller, and an axial balancing device arranged on at least one impeller of the rotor in which (or especially, though not exclusively, having a wall, in particular a front wall, against which) a fluid duct passes, said device comprising for each involved wheel in this device a balancing chamber extending between a wall of said involved wheel and the stator, and a passage arranged between said involved wheel and the stator, enabling evacuation of fluid from said fluid duct to said balancing chamber, said rotor having slight axial clearance permitting limited axial shift, the fluid pressure in the balancing chamber or chambers consequently able to compensate pressures exerted by the fluid on the other parts of the rotor to produce axial balancing of the rotor; a pump whereof the balancing device of axial thrust can be made using conventional machining means and which has optimised radial and axial bulk so as to produce a compact pump having good hydraulic output.

This aim is attained due to the fact that said passage comprises an upstream nozzle and a downstream nozzle, both axially variable, extending between two crown walls opposite one another with a positive, zero or negative covering, respectively of the involved wheel and of the stator, and an intermediate annular chamber arranged between walls of the involved wheel and of the stator, opening downstream of the upstream nozzle and upstream of the downstream nozzle of said passage. Due to the arrangement of the passage with an annular chamber placed between two nozzles, the jet of fluid passes through and circulates in the intermediate chamber, in which it dissipates its kinetic energy by whirling, resulting in increased pressure loss on either side of the passage. The term "chamber" here implies that the annular chamber differs from the upstream and downstream nozzles by a large flow area relative to that of the nozzles, which could especially be more than triple their flow area. In the preceding wording, said upstream and downstream nozzles are annular parts of the passage having particularly small sections relative to the rest of the passage, or at least smaller than the average section of the latter. These nozzles are called axially variable, as their flow areas act as a function of axial shifts of the rotor relative to the stator. An example of axially variable nozzle is a passage extending radially between two parallel circular plane crowns, perpendicular to the axis of rotation of the pump. Axial moving towards or away of these crowns causes proportional reduction or increase of the flow area between the crowns.

It is evident that the crown walls opposite one another of the upstream and/or downstream nozzles can have positive, zero or negative covering. These walls can thus have or not have radial covering. There is radial covering when the two opposite surfaces constituting the nozzle have effective covering in the radial direction, that is, they are at least in part opposite according to the axis of the pump (this means that a shift along the axis of the pump of the rotor relative to the stator could put these surfaces in contact). Inversely, the absence of covering corresponds to the situation in which these two surfaces are not opposite along the axis of the pump, even though they are opposite one another, that is, although their normals are in the same direction but of opposite direction. In all cases (with or without radial covering), the surfaces of a nozzle are placed such that their relative axial shift induces a variation in the flow area of the nozzle, that is, in the flow area between them.

In an embodiment, the section of the annular chamber in a meridian plane is only slightly elongated, that is, it has a larger dimension less than double its smaller dimension. This arrangement favors dissipation of energy by whirling.

The invention is particularly advantageous in the case of pumps arranged for pumping liquid hydrogen. In such pumps in fact, the impeller or impellers can reach a periphery speed greater than 400 m/s, or even 500 m/s.

It is understood that in these conditions any unwanted contact happening at the periphery of the wheels between an impeller and the stator can have considerable consequences. The form of the fluid evacuation area is therefore essential, as it relates to precisely this part of the pump. Advantageously, the invention allows the passage to create a substantial pressure loss, while having minimal axial and radial bulk, and this without adding any unacceptable extra manufacturing costs.

In an embodiment, the fluid evacuation passage is substantially airtight, with the exception of entry of fluid via the upstream nozzle, and evacuation of fluid via the downstream nozzle. In this way, no evacuation or intake of fluid takes place from the upstream to the downstream of the passage. In particular, the intermediate annular chamber is substantially airtight with the exception of the fluid passage through the upstream and downstream nozzles, and there is no exchange path of fluid provided other than the upstream and downstream nozzles.

Finally, in an embodiment the upstream nozzle and the downstream nozzle are radially tiered. In other words, the upstream nozzle and the downstream nozzle are situated at different distances from one another relative to the axis of rotation of the pump. Because of this arrangement, it is possible to produce an axially compact axial balancing device, that is, of minimal length along the axis of the pump. The annular chamber especially can be placed radially between a radius of the upstream nozzle and a radius of the downstream nozzle (a radius of a nozzle here designating the radius of section of lesser passage of the nozzle).

In general, various forms of revolution about the axis of the pump can be adopted for the nozzles, the nozzles all the same having necessarily to extend radially, but for example able to have a conical or other form, and the respective opposite surfaces of the wheel and of the stator having to correspond geometrically. It is evident that the expression "opposite one another" here indicates respectively for each of the nozzles that the walls of the wheel and of the stator are substantially opposite one another, the two nozzles also being offset relative to one another axially and/or radially.

Due to the presence in the passage of two nozzles separated by an intermediate chamber, instead of a single radial nozzle, for a given axial clearance the pressure loss generated by the passage is increased, without the radial extension of the nozzle having increased.

Inversely, given the pressure loss which allows balancing of the rotor, the choice of this conformation advantageously results in increasing the axial clearance between the rotor and the stator, which leads to increased operating safety for these two pieces.

The axial and/or radial compactness of the pump is improved, especially by avoiding adding an out-of-alignment axial balancing plate.

In an embodiment, at least one of the upstream nozzle and the downstream nozzle extends in a plane perpendicular to the axis of the pump.

In addition and advantageously, the balancing device of axial thrust can be arranged in only a single impeller. It can therefore be utilised when the rotor comprises only one impeller.

This being the case, the balancing thrust device can just as well be used in a rotor comprising a plurality of impellers.

In this case, it can be provided that the only involved wheel is the last wheel at the rear of the pump, that is, the one situated the farthest downstream in the direction of advance of the fluid in the pump.

As an alternative solution, it can likewise be ensured that the balancing device of axial thrust involves at least two wheels, and in particular all wheels. Therefore, forces are distributed more uniformly within the rotor.

Finally, it should be noted that the principle of interposition of the intermediate chamber, separated by radial nozzles, can be multiplied or reiterated. According to the invention, it is possible to ensure that the passage also comprises at least one other intermediate nozzle extending between two crown walls opposite one another, respectively of the rotor and of the stator, and at least one other intermediate annular chamber arranged between the rotor and the stator, opening downstream of this intermediate nozzle, the intermediate nozzle or nozzles and intermediate annular chamber or chambers being interposed alternated on the trajectory of fluid downstream of the first intermediate annular chamber and upstream of the downstream nozzle.

In the resulting configuration, there is therefore a suite of consecutive intermediate chambers, separated by radial nozzles. An identical throughput of fluid, the jump in pressure generated by the passage can be even greater than with a single intermediate chamber.

Finally, the invention applies more particularly to manufacturing turbopumps for spatial motors, linking a pump such as described previously coupled to a turbine.

BRIEF DESCRIPTION OF DRAWINGS

The invention will be better understood and its advantages will emerge more clearly from the following detailed description of embodiments shown by way of non-limiting examples. The description refers to the attached diagrams, in which.

DETAILED DESCRIPTION

Figure 1:
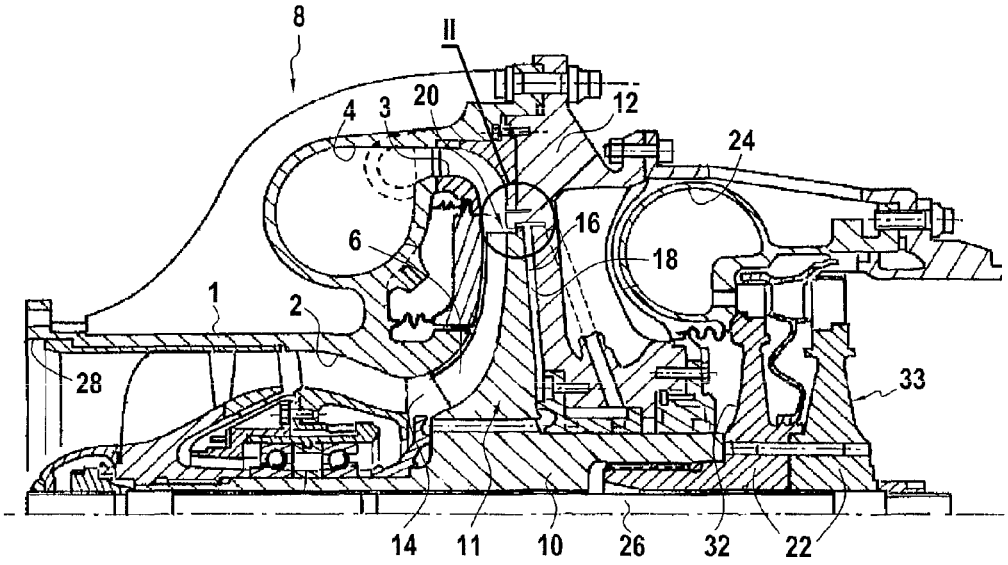
FIG.1 PRIOR ART
FIG. 1 already described is an axial sectional view of a centrifuging pump equipped with a thrust balancing device, FIG. 2 already described is an axial sectional view of a fluid-transfer passage of this device, in a known conformation.
Figure 2:
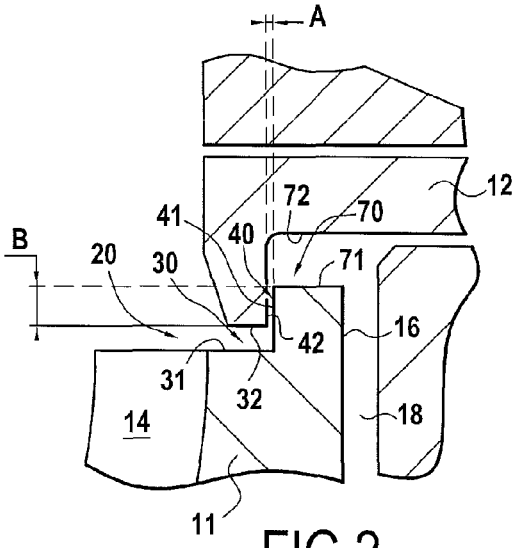
FIG.2 PRIOR ART

Whenever an element appears in several figures, either identical or in similar form, it is described in relation to the first figure in which it appears; in the following figures it bears a reference numeral which is its initial reference numeral, increased by 100, 200, etc. Also, the description of the element is given once only, as in the following Figures, it is omitted or simplified.

Figure 3:
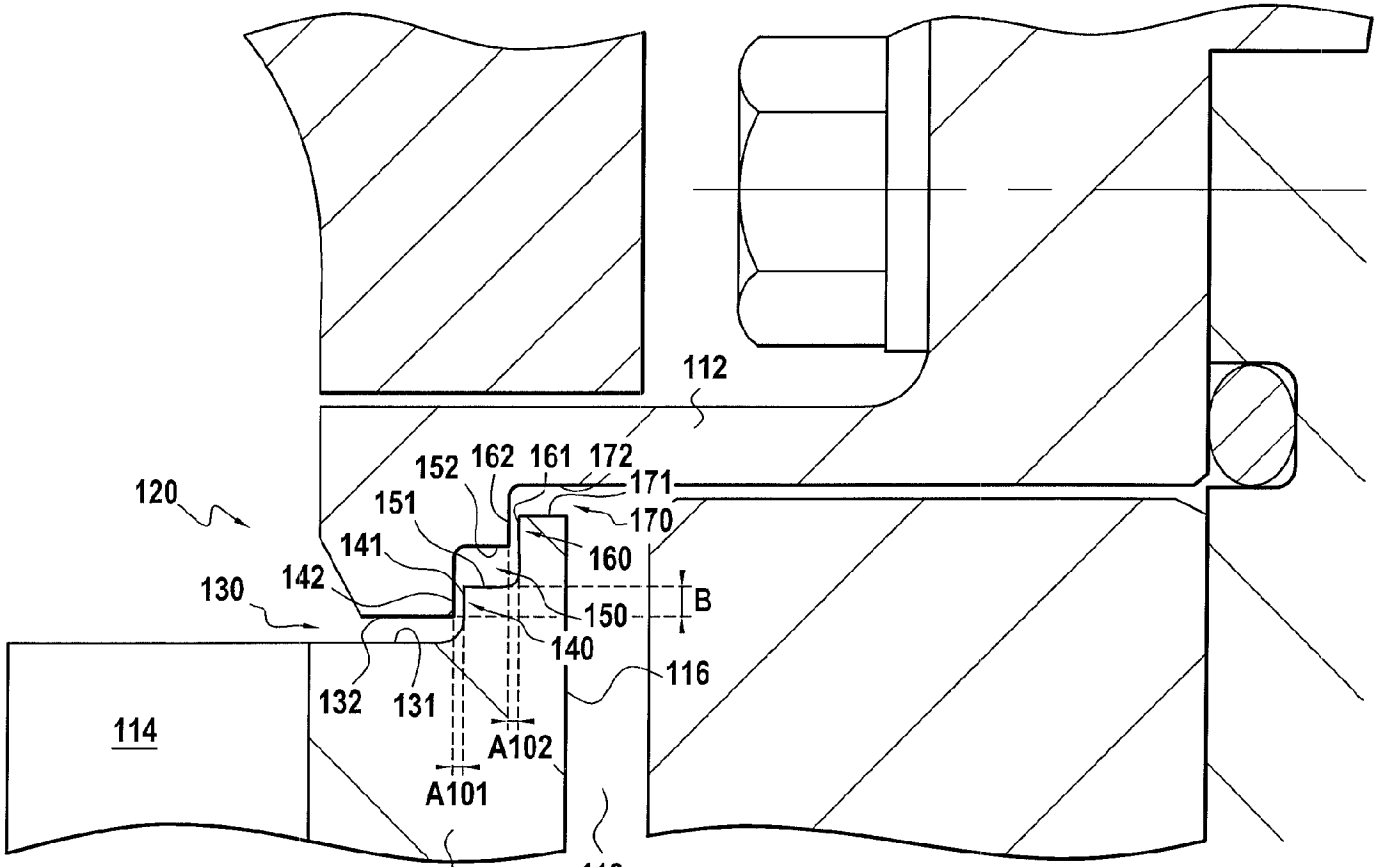
FIG. 3 is an axial sectional view of a fluid-transfer passage of an axial balancing pump device, in a first embodiment of the invention.
Figure 4:
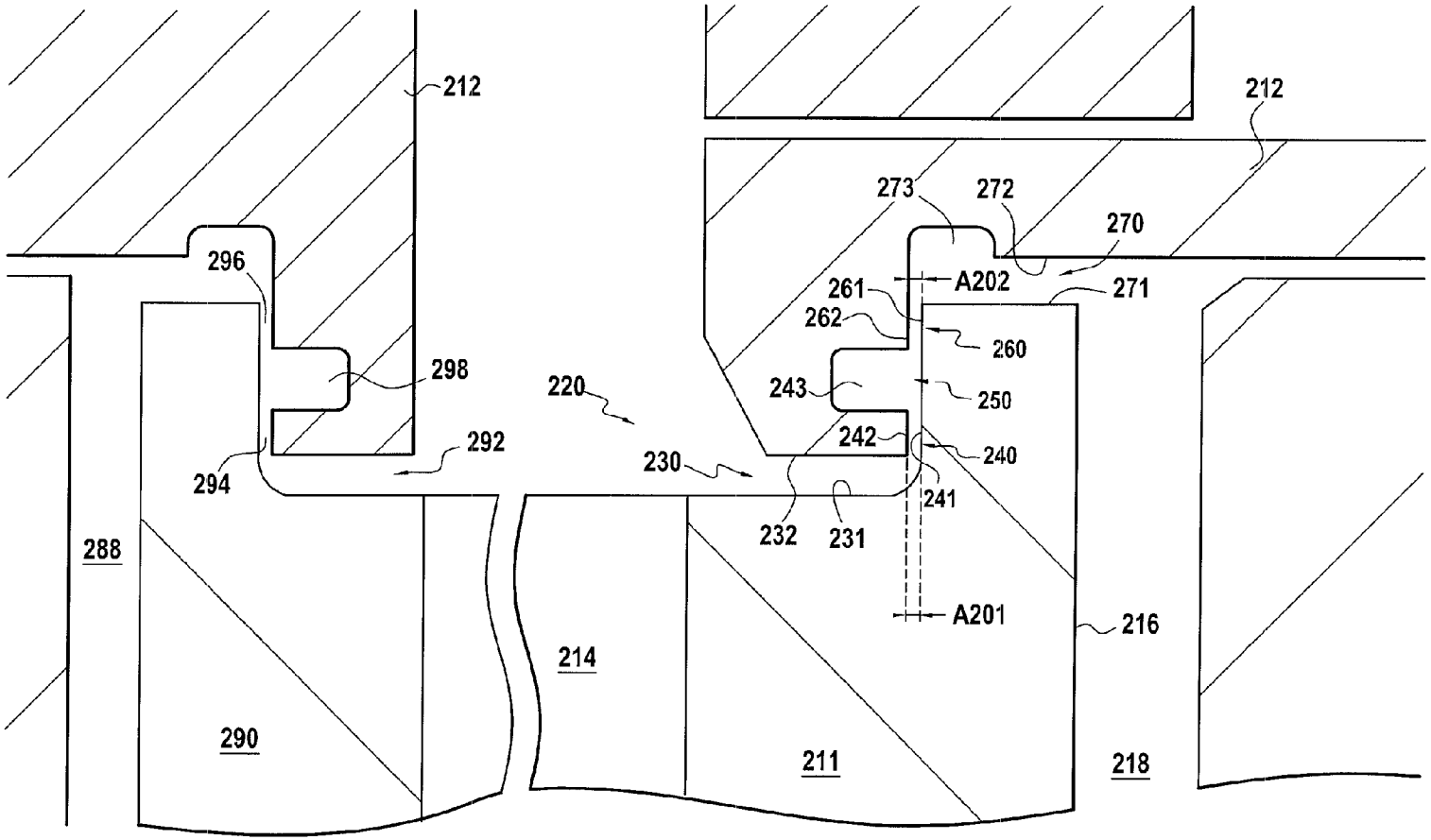
FIG. 4 is an axial sectional view of a fluid-transfer passage of an axial balancing pump device, in a second embodiment of the invention.
Figure 5:
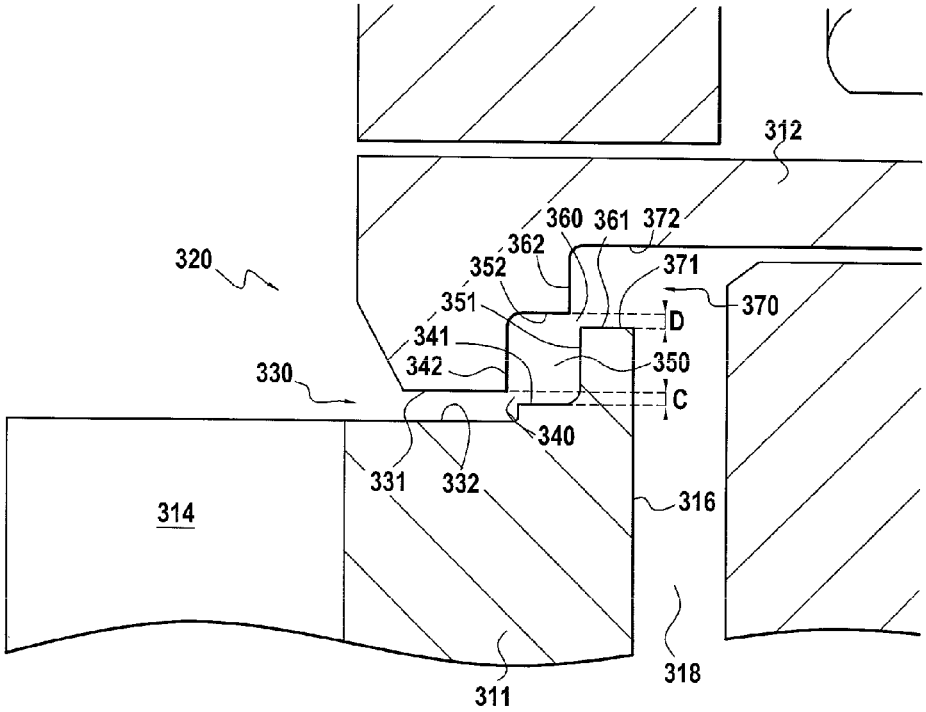
FIG. 5 is an axial sectional view of a fluid-transfer passage of an axial balancing pump device, in a third embodiment of the invention.

FIGS. 3 to 5 illustrate axial balancing devices, likely to be used in a pump such as that presented in relation to FIG. 1.

The operation of a pump axial balancing device, in a first embodiment of the invention, will now be described in reference to FIG. 3.

FIG. 3 is a partial section of a pump overall similar to that presented in FIG. 1, specifically a single-stage pump comprising a wheel 111 of open type. However, the balancing device of the pump of FIG. 3 is different to that of the pump of FIG. 1.

The pump illustrated in FIG. 3 comprises a rotor 114 and a stator 112, and a thrust balancing device comprising especially a fluid passage 120 formed between the rotor 114 and the stator 112.

In the pump of FIG. 3, the thrust device is arranged on the rear wall of the impeller. It is understood of course that in general the thrust device can be arranged also just as easily on a rear wall of the wheel 111 as on a front wall of the latter.

Upstream to the side of the fluid duct, the passage 120 comprises an upstream axial part 130 extending between two substantially cylindrical walls 131,132 of circular section opposite one another, respectively of the wheel 111 (involved wheel) and the stator 112, situated upstream of the upstream nozzle 140. This upstream axial part constituting a cavity advantageously allows initial dissipation of kinetic energy of fluid passing through the passage 120.

Immediately downstream of the upstream axial part extends the upstream nozzle 140. The latter is a passage extending radially over a distance B between the walls 141 and 142 respectively of the wheel and of the stator. There is therefore, over the distance B, an effective radial covering between the surfaces 141 and 142

Downstream of the upstream nozzle 140 extends the intermediate chamber 150. The latter is annular in shape and extends between the walls 151 and 152 of the wheel 111 and of the stator 112. The chamber can be arranged variously in the volume of the wheel and/or of the stator. With the exception of the upstream and downstream nozzles, the chamber 150 is airtight.

The annular chamber 150 is short in length in the radial direction, since it extends radially over less than a tenth, and more precisely less than a twentieth of the radius of the wheel 111 at the level of the upstream nozzle.

In addition, it is likewise short in length in the axial direction, since it extends axially over less than a tenth, and more precisely less than a twentieth of the radius of the wheel 111 at the level of the upstream nozzle.

Downstream of this intermediate chamber 150 extends the downstream nozzle 160 between the walls 161 and 162 respectively of the wheel and of the stator. The latter likewise has positive covering.

The radial upstream and downstream nozzles respectively define axial clearances A101 and A102, equal or not, between the wheel 111 and the stator 112.

Also, the upstream and downstream nozzles are radially tiered. In this way, the upstream nozzle 140 is at a lesser radial distance relative to the axis of rotation of the pump than the downstream nozzle 160. These two nozzles are separated by the distance radially separating the walls 151 and 152 respectively of the rotor and of the stator, which corresponds to the radial extension of the annular chamber 150.

Finally, downstream of the downstream nozzle 160, the passage 120 comprises a downstream axial part 170 extending between two substantially cylindrical walls 171,172 of circular section opposite one another, respectively of the wheel 111 (involved wheel) and of the stator 112, situated downstream of the downstream nozzle 160.

Just as does the upstream axial part, this downstream axial part likewise comprises a cavity allowing dissipation of kinetic energy of fluid passing through the passage 120.

Even if a cylindrical of circular section form (the axis being that of the pump) is preferable, these axial upstream and downstream parts of the passage 120 can take on other forms of revolution about the axis of the pump, for example present a convergent (upstream) or a divergent (downstream) between conical surfaces opposite one another respectively of the wheel 111 and of the stator 112.

In reference to FIG. 4, a device in a centrifuging pump in a second embodiment of the invention will now be described.

In this embodiment, at least one involved wheel in the axial balancing device, and in this case the impeller 211 is a closed, or flanged wheel, that is, closed by a cover 290 (or flange) to the front side of the vanes. To allow axial balancing in both directions along the axis of the pump, the axial balancing device is doubled, comprising first axial balancing means (especially a first passage 220) very similar to those presented in relation to FIG. 3, and second axial balancing means acting in the opposite direction, placed to the side of the cover.

In this embodiment, the different elements of the first axial balancing means, and especially the passage 220, are substantially the same as in the preceding embodiment and therefore will not be described in any further detail.

Concerning these first axial balancing means placed on the rear side of the wheel 211, the differences are the following.

First of all, the radial upstream and downstream nozzles extend substantially in the same plane perpendicular to the axis of rotation of the rotor, whereas on the contrary in the embodiment presented in FIG. 3, the radial upstream 140 and downstream nozzles 160 are slightly offset along the axis of rotation of the pump. So in the embodiment of FIG. 4, in which the radial upstream and downstream nozzles are in the same plane, machining the surfaces 241, 261 of the wheel and 242, 262 of the stator is simplified. In addition, the axial bulk of the axial balancing device is not increased as a result, relative to the axial balancing device presented in FIG. 1.

It is also noted that the intermediate chamber has been arranged in the stator only. As this chamber can be subjected to rapid wear and/or vibrations, advantageously the latter are concentrated in the stator and not in the rotating assembly of the pump.

Moreover, an annular chamber 273 is arranged in the upstream part of the downstream axial part 270, in the vicinity of the outlet section of the downstream nozzle 260 of the passage 220. Forcing the fluid to circulate likewise in this annular chamber 273 further boosts the pressure loss during traversing of the passage 220. A similar cavity can be provided symmetrically in the downstream part of the upstream axial part 230, in the vicinity of the inlet section of the upstream nozzle 240.

Finally, the axial balancing device comprises second axial balancing means for the wheel 211, to prevent it shifting to the front.

The axial balancing device comprises another balancing chamber 288, called a front balancing chamber, extending between a front wall of the cover 290 and the stator 212, a second passage 292 arranged between the cover and the stator, allowing evacuation of fluid from the fluid duct 214 to the front balancing chamber 288, the second passage 292 comprising an upstream nozzle 294 and a nozzle 296, these nozzles extending between two crown walls opposite one another, respectively of the cover 290 on the front side and of the stator 212 on the rear side, and an intermediate annular chamber 298 arranged between walls respectively of the cover 290 and of the stator 212, the intermediate annular chamber 298 opening downstream of the upstream nozzle 294 and upstream of the downstream nozzle 296 of the second passage 292.

The structure of the second balancing means is functionally equivalent to that of the first means, but the second means are placed in an opposite direction relative to the axis of the pump. Due to this conformation of the axial balancing device with balancing means of opposite directions placed on the two sides of the wheel, the axial shifts of the rotor are compensated in both directions. Finally, it is evident that according to the invention the balancing device can be placed on one or more flanged wheels, each provided with balancing means in both directions.

In reference to FIG. 5, a device in a centrifuging pump in a third embodiment of the invention will now be described.

In this embodiment, the different elements of the axial balancing means, and especially the passage 320, are substantially the same as in the first embodiment and therefore will not be described in any further detail.

The particular feature of this third embodiment, relative to the first embodiment, is the absence of radial covering between the surfaces of the upstream 340 and downstream nozzles 360.

In this embodiment, the nozzles 340 and 360 actually have no radial covering. In fact, for each of these nozzles, the surfaces of the nozzles 341, 361; 342,362 respectively of the rotor and of the stator, comprise no part opposite along the axis of the pump. More precisely, with respect to the upstream nozzle 340, the surfaces 341 and 342 constituting this nozzle are separated by a radial distance C; with respect to the downstream nozzle 360, a radial distance D separates the surfaces 361 and 362 constituting this nozzle. The significance of this conformation is that since the surfaces of the nozzles have no radially common part, or in other words, are radially offset, the relative axial movements of the rotor relative to the stator cannot result in contact between rotor and stator. This property can be absolutely indispensable in the event where such contact would cause heating for the machine resulting in its destruction.

What is claimed is:

1. A pump comprising:

a stator, a rotor comprising at least one impeller, and an axial balancing device arranged on a first impeller of the at least one impeller of the rotor in which a fluid duct passes, said axial balancing device comprising:

a balancing chamber extending between a wall of said first impeller and the stator, and a passage arranged between said first impeller and the stator, allowing evacuation of fluid from said fluid duct to said balancing chamber;

said rotor having slight axial clearance allowing limited axial shift;

wherein in said axial balancing device, said passage comprises an upstream nozzle and a downstream nozzle, both axially variable, extending with a positive, zero or negative covering between two walls in a crown opposite to one another, respectively of the first impeller and of the stator, the upstream nozzle extending from a tip portion of the first impeller, and an intermediate annular chamber facing the upstream nozzle, wherein the intermediate annular chamber is arranged between walls of the first impeller and of the stator, opening downstream of the upstream nozzle and upstream of the downstream nozzle of said passage;

wherein the upstream and downstream nozzles are located on a same side of the first impeller while the balancing chamber is located on an opposite side of the first impeller.

2. The pump as claimed in claim 1, wherein the intermediate annular chamber is substantially airtight with the exception of the fluid passage via the upstream and downstream nozzles.

3. The pump as claimed in claim 1, wherein one at least of the upstream nozzle and the downstream nozzle extends in a plane perpendicular to an axis of the pump.

4. The pump as claimed in claim 1, wherein said passage also comprises an upstream axial part extending between two substantially cylindrical walls of circular section opposite one another, respectively of the first impeller and of the stator, and situated upstream of the upstream nozzle.

5. The pump as claimed in claim 1, wherein said passage also comprises a downstream axial part extending between two walls substantially cylindrical of circular section opposite one another, respectively of the first impeller and of the stator, and situated downstream of the downstream nozzle.

6. The pump as claimed in claim 5, wherein an annular chamber is arranged in the upstream part of the downstream axial part, in the vicinity of the outlet section of the downstream nozzle of the passage.

7. The pump as claimed in claim 1, wherein said passage also comprises at least one other nozzle known as intermediate, extending between two crown walls opposite one another, respectively of the rotor and of the stator, and at least one other intermediate annular chamber arranged between the rotor and the stator, opening downstream of this intermediate nozzle, said at least one intermediate nozzle and at least one intermediate annular chamber being interposed alternated on the trajectory of fluid downstream of said intermediate annular chamber and upstream of said downstream nozzle.

8. The pump as claimed in claim 1, wherein the upstream and downstream nozzles extend substantially in the same plane perpendicular to the axis of rotation of the rotor.

9. The pump as claimed in claim 1, wherein the rotor comprises only one impeller.

10. The pump as claimed in claim 1, wherein the rotor comprises a plurality of impellers, the first impeller being situated at a location farthest downstream in the direction of advance of the fluid in the pump.

11. The pump as claimed in claim 1, wherein the first impeller in the axial balancing device is a flanged wheel closed by a cover on the front side of the vanes;

said balancing chamber and said passage are arranged on a rear side of said flanged wheel, between a rear wall of the flanged wheel and the stator;

said device also comprises for said flanged wheel another balancing chamber known as front balancing chamber, extending between a front wall of said cover and the stator, a second passage arranged between the cover and the stator, allowing evacuation of fluid from said fluid duct to said front balancing chamber, said second passage comprising an upstream nozzle and a downstream nozzle, these nozzles extending between two opposite crown walls, respectively of the cover on the front side and of the stator on the rear side, and an intermediate annular chamber arranged between walls respectively of the cover and of the stator, said intermediate annular chamber opening downstream of the upstream nozzle and upstream of the downstream nozzle of said second passage.

12. The pump as claimed in claim 1, wherein said first impeller is provided to reach a periphery speed greater than 400 m/s.

13. The pump as claimed in claim 1, arranged for pumping liquid hydrogen.

14. A turbopump for spatial motor, said turbopump being the pump of claim 1.

15. A pump comprising:

a stator, a rotor comprising at least one impeller, and an axial balancing device arranged on a first impeller of the at least one impeller of the rotor in which a fluid duct passes, said device comprising:

a balancing chamber extending between a wall of said first impeller and the stator, and a passage arranged between said first impeller and the stator, allowing evacuation of fluid from said fluid duct to said balancing chamber;

said rotor having slight axial clearance allowing limited axial shift;

wherein in said axial balancing device, said passage comprises an upstream nozzle and a downstream nozzle, both axially variable, extending with a positive, zero or negative covering between two walls in a crown having normals in a same direction but of opposite direction, respectively of the first impeller and of the stator, the upstream nozzle extending from a tip portion of the first impeller, and an intermediate annular chamber facing the upstream nozzle, wherein the intermediate annular chamber is arranged between walls of the first impeller and of the stator, opening downstream of the upstream nozzle and upstream of the downstream nozzle of said passage;

wherein, due to the arrangement of the passage with the annular intermediate chamber placed between the two nozzles, the axial balancing device modulates the pressure of the balancing chamber so that the pressure in the balancing chamber applied on the first impeller acts to regulate and slave the position of the first impeller.

16. The pump as claimed in claim 15, wherein the intermediate annular chamber is substantially airtight with the exception of the fluid passage via the upstream and downstream nozzles.

17. The pump as claimed in claim 15, wherein at least one of the upstream nozzle and the downstream nozzle extends in a plane perpendicular to the axis of the pump.

18. The pump as claimed in claim 15, wherein said passage also comprises an upstream axial part extending between two substantially cylindrical walls of circular section opposite one another, respectively of the first impeller and of the stator, and situated upstream of the upstream nozzle.

19. The pump as claimed in claim 15, wherein said passage also comprises a downstream axial part extending between two walls substantially cylindrical of circular section opposite one another, respectively of the first impeller and of the stator, and situated downstream of the downstream nozzle.

20. The pump as claimed in claim 19, wherein an annular chamber is arranged in an upstream part of the downstream axial part, in the vicinity of the outlet section of the downstream nozzle of the passage.

* * * * *